US006658743B2

(12) United States Patent
Dudley, Jr. et al.

(10) Patent No.: US 6,658,743 B2
(45) Date of Patent: Dec. 9, 2003

(54) SKINNING KNIFE

(76) Inventors: Calvin D. Dudley, Jr., 5177 Boonsboro Rd., Lynchburg, VA (US) 24503; Franklin A. Swann, 101 Alydar Pl., Lynchburg, VA (US) 24503

( * ) Notice: Subject to any disclaimer, the term of this patent is extended or adjusted under 35 U.S.C. 154(b) by 49 days.

(21) Appl. No.: 10/141,955

(22) Filed: May 10, 2002

(65) Prior Publication Data

US 2003/0208910 A1 Nov. 13, 2003

(51) Int. Cl.[7] ..... B26B 3/00
(52) U.S. Cl. ..... 30/314; 30/353; D22/118
(58) Field of Search ..... 30/353, 314, 357, 30/317, 315; D22/118; D7/649, 650

(56) References Cited

U.S. PATENT DOCUMENTS

| | | | | | |
|---|---|---|---|---|---|
| 81,619 | A | * | 9/1868 | Fuller | 30/314 |
| 449,031 | A | | 3/1891 | Bernard | |
| 2,007,700 | A | * | 7/1935 | Ziminski | 30/353 |
| 2,279,833 | A | | 4/1942 | Madan | |
| D156,070 | S | | 11/1949 | Brooks | |
| 2,517,158 | A | * | 8/1950 | Chatlos | 30/314 |
| D166,394 | S | * | 4/1952 | Herold | D22/118 |
| 2,635,337 | A | * | 4/1953 | Mercy | 30/353 |
| 3,241,236 | A | * | 3/1966 | Capps | 30/314 |
| 3,918,158 | A | * | 11/1975 | Debski | 30/314 |
| D257,056 | S | | 9/1980 | Spivey | |
| 4,283,854 | A | | 8/1981 | Austin | |
| D299,375 | S | | 1/1989 | Pipes | |
| 5,033,987 | A | | 7/1991 | Bloch | |
| D330,405 | S | | 10/1992 | Luchak | |
| D362,485 | S | | 9/1995 | Hall | |
| D380,520 | S | | 7/1997 | Hibben | |
| D398,211 | S | | 9/1998 | Howard | |
| D409,270 | S | | 5/1999 | Balolia | |
| D464,551 | S | * | 10/2002 | Clesser | D22/118 X |

FOREIGN PATENT DOCUMENTS

| | | |
|---|---|---|
| GB | 510151 | 7/1939 |

* cited by examiner

*Primary Examiner*—Douglas D. Watts
(74) *Attorney, Agent, or Firm*—Richard C. Litman

(57) ABSTRACT

A combination game knife having a handle and a blade portion having a tip, a top back edge and a bottom front edge and a rear portion opposite the tip, the blade portion having up to five cutting surfaces. A unique feature is a small gut hook positioned below the forefinger aperture in the rear of the blade portion and above the handle and opening toward the user. Other cutting surfaces are the back cutting edge, a top back large gut hook, a front bottom cutting edge, a front serrated edge to the rear of the front cutting edge, and a bottom edge small gut hook to the rear of the serrated edge and in the vicinity of the handle. A forefinger aperture is spaced toward the back edge from the small gut hook near the handle.

20 Claims, 2 Drawing Sheets

SKINNING KNIFE

BACKGROUND OF THE INVENTION

1. Field of the Invention

The present invention relates generally to knives, and more specifically, to a combination knife having at least five cutting surfaces, and further including a second smaller gut hook located below a forefinger grip aperture.

2. Description of Related Art

The relevant art of interest describes various knives, but, none discloses the present invention. There is a need for a gut hook positioned on a bottom edge of the knife to prevent the necessity to release one's grip on the bloody knife to utilize the upper gut hook, and thus eliminate the dripping of blood on other surfaces.

The relevant art of interest will be discussed in the order of perceived relevance to the present invention.

U.S. Des. Pat. No. 380,520 issued on Jul. 1, 1997, to Gil Hibben describes an ornamental knife having at least six hooked and unsharpened portions on the knife blade. There is only one sharpened cutting surface on the front surface, and adjacent four hooked portions. A set of two hooked portions is on the back edge of the blade. The ornate hilt has a guard section on top and a lower section through which the longest hook of the blade extends as a hand guard. There are two grip sections underneath and a knob on the end of the hilt. The ornate knife is distinguishable for its nonfunctional parts and the lack of cutting gut hooks.

U.S. Des. Pat. No. 156,070 issued on Nov. 22, 1949, to Oakley Brooks describes a hunting knife having a serrated region and a piercing point on the back edge of the blade. The front edge of the pointed blade is sharpened and ends in an unsharpened hook at the hilt. The hilt has a flat square end having ridges. The hunting knife is distinguishable for its dull edged hook.

U.S. Des. Pat. No. 257,056 issued on Sep. 23, 1980, to Jefferson Spivey describes an ornamental design for a knife comprising a blade having a lower unsharpened hooked portion and an upper guard portion having a circular depression on one side. The curved handle has a finger hole and an eyelet at its end. The knife is distinguishable for its single unsharpened hook portion which faces toward the knife point.

U.S. Des. Pat. No. 330,405 issued on Oct. 20, 1992, to Robert M. Luchak describes an ornamental design for a skinning knife comprising a short curved blade with a circular forefinger aperture and a gut hook having a hinged guard bar. The curved handle has another finger aperture adjacent the gut hook and two other finger depressions. The skinning knife is distinguishable for having two finger holes and lacking the features of a serrated edge, a triangular aperture and another gut hook on the back edge.

U.S. Pat. No. 4,283,854 issued on Aug. 18, 1981, to Marvin L. Austin describes a hunter's knife adapted for eviscerating and skinning a game animal in the field. A stainless steel knife has an integrated blade and handle. The blade portion has a gut hook on its back edge. The handle has a T-shaped finger engaging member separating one finger notch from two others. The knife is distinguishable for lacking a second bottom gut hook, a triangular aperture, a forefinger aperture, and a serrated blade portion.

U.S. Des. Pat. No. 299,375 issued on Jan. 10, 1989, to Kevin G. Pipes describes an ornamental design for a combination knife comprising a rear edge of the blade having an inclined serrated portion, an unsharpened hook, and a sharpened knife proximate the hilt guard. The front edge is pointed and consists of a forward sharpened edge and a serrated rear edge. The knife is distinguishable for its required inclined serrated region, an unsharpened hook, and sharp edge portion on the rear edge of the blade.

U.S. Des. Pat. No. 362,485 issued on Sep. 19, 1995, to David K. Hall describes an ornamental design for a knife comprising a short curved blade having a top gut hook and a notched region and a handle having two finger holes, a forward bottom notch and a hole at its end. The knife is distinguishable for lacking a bottom gut hook, a bottom serrated edge, and a triangular aperture in its blade.

U.S. Des. Pat. No. 409,270 issued on May 4, 1999, to Shiraz Balolia describes an ornamental design for a game blade comprising a short curved blade having a top gut hook, a notched edge and a finger hole. The handle has a distal aperture. The game blade is distinguishable for lacking a second bottom gut hook, a bottom serrated edge region, and a triangular aperture.

U.S. Pat. No. 449,031 issued on Mar. 24, 1891, to Peter J. Bernard describes a tobacco cutting or pruning knife comprising a handle with transverse forefinger receiving opening and a curved blade whose tang extends along the handle and has two opposing sharp edges. The knife is distinguishable for its two-bladed structure.

Great Britain Patent Application No. 510,151 published on Jul. 27, 1939, describes a sheath knife comprising a sheath for a knife blade consisting of a flat point for use as a chisel or screwdriver, a knife blade portion, and on the opposite rear edge sawteeth and a crown cork opener. The cylindrical hollow two-piece handle has a forward handle section with a spring operated stud or a bayonet joint, and a rear handle portion forming a casing with a hammer head tip for a tin opener which is an extension of the blade. The knife is distinguishable for its non-sharpened cork opener and two-piece structure.

U.S. Pat. No. 5,033,987, issued Jul. 23, 1991, to David Bloch describes a cutting and skinning knife having a upwardly curved sharp beveled front edge and a gut hook on the back edge and having a grip handle generally crosswise of the knife at an angle parallel to the sharp beveled front edge at a point near its front tip. The knife is distinguishable in that it does not provide a second gut hook on its front edge in the vicinity of the handle.

Patents having some relevance also include U.S. Des. Pat. No. 398,211, issued Sep. 15, 1998 to H. S. Howard (ornamental design for a utility knife); U.S. Pat. No. 2,279,833, issued Apr. 14, 1942 to E. K. Madan (a household knife); and U.S. Pat. No. 2,635,337, issued Apr. 21, 1953 to L. Marcy (notched linoleum cutting knife).

It should be noted that design patents neither suggest nor teach other additional features to their knives.

None of the above inventions and patents, taken either singly or in combination, is seen to describe the instant invention as claimed.

SUMMARY OF THE INVENTION

The present invention is directed to a combination knife for skinning and eviscerating game having a handle and a blade portion having a tip, a top back edge and a bottom front edge and a rear portion opposite the tip, the blade portion having up to five cutting surfaces. A unique feature of the blade portion is a small gut hook positioned below the forefinger aperture in the rear portion of the blade portion and in the vicinity of the handle and opening toward the user. Other cutting surfaces are the back cutting edge, a top back large gut hook, a front bottom cutting edge, a front serrated edge to the rear of the front cutting edge, and a bottom edge small gut hook to the rear of the serrated edge and in the vicinity of the handle. A triangular aperture is located along the back edge between the large gut hook and the handle. A forefinger aperture is spaced toward the back edge from the small gut hook and in the vicinity of the handle. The handler has a front 3-finger hold portion and an aperture at its end for a cord loop is provided.

Accordingly, it is a principal object of the invention to provide a combination knife having a second gut hook.

It is another object of the invention to provide a combination knife having up to five cutting edges including a top front cutting edge, a top large gut hook, a bottom front cutting edge, a bottom rear serrated edge, and a bottom rearmost small gut hook.

It is a further object of the invention to provide a combination knife having at least five cutting edges, a triangular aperture, a forefinger aperture, and two gut hooks on opposite edges of the blade.

Still another object of the invention is to provide a combination knife having at least five cutting edges, a three-finger handle with a looped cord, and two gut hooks of disparate, size on opposite edges of the blade.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
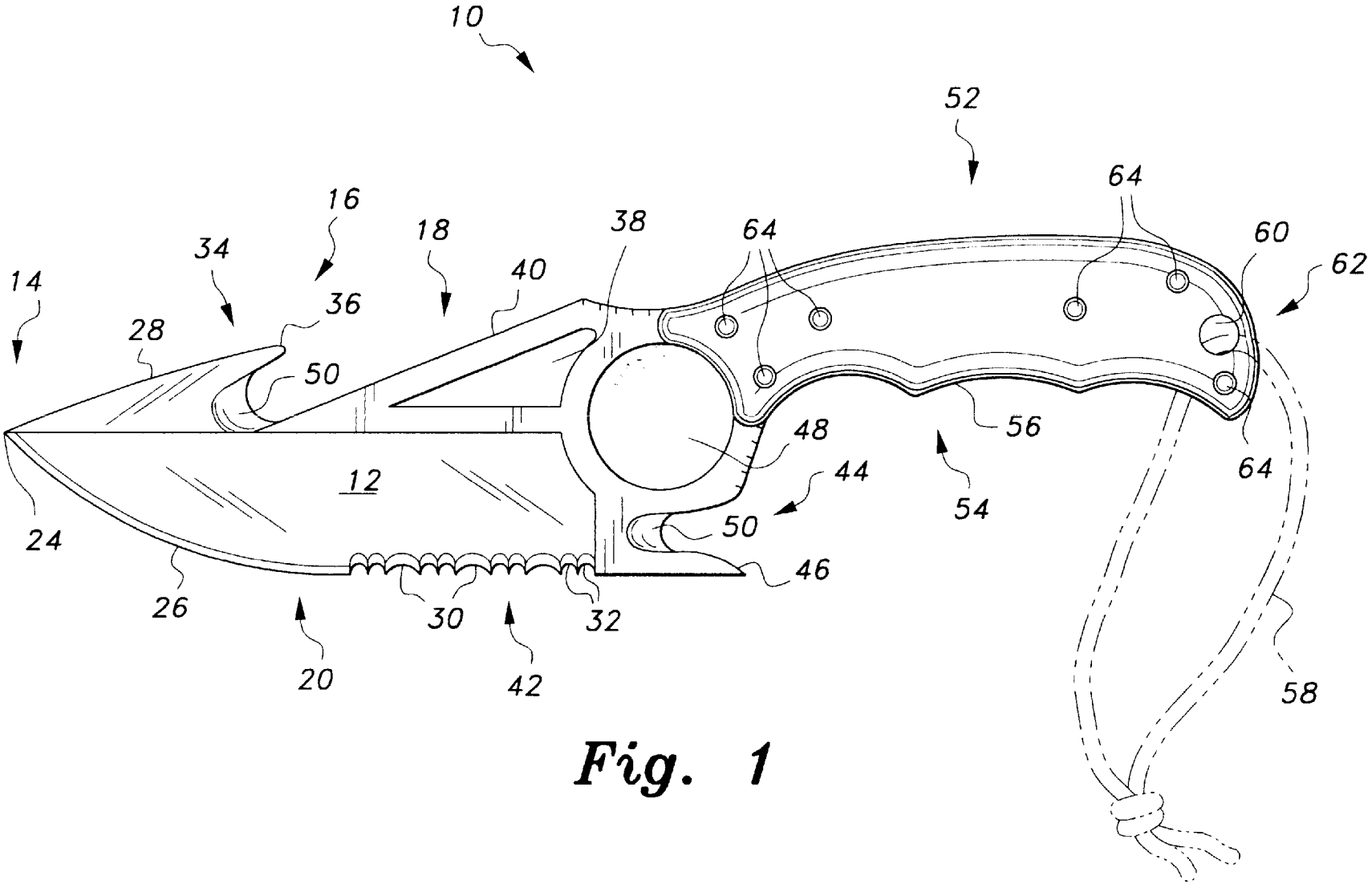
FIG. 1 is a side elevational view of a skinning knife according to the present invention.
Figure 2:
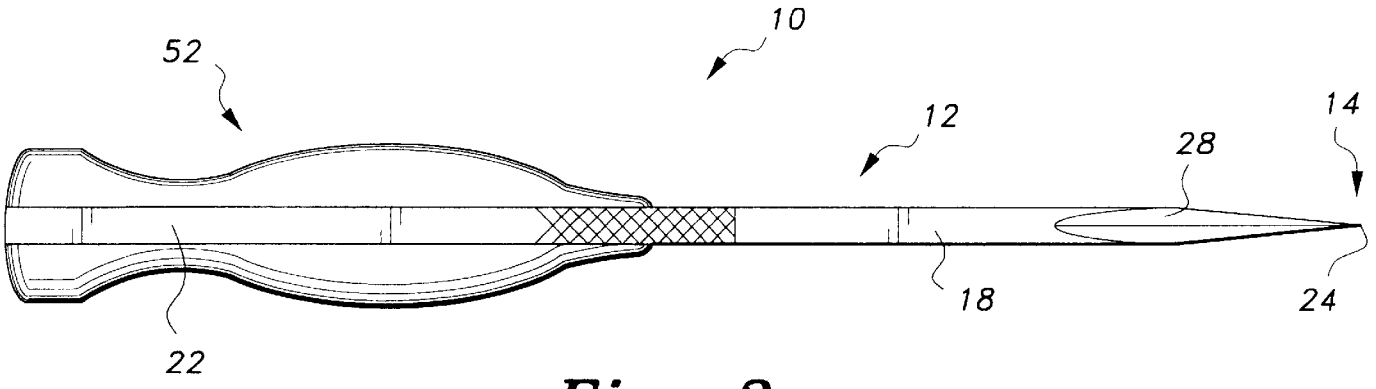
FIG. 2 is a top plan view of the skinning knife according to the present invention.
Figure 3:
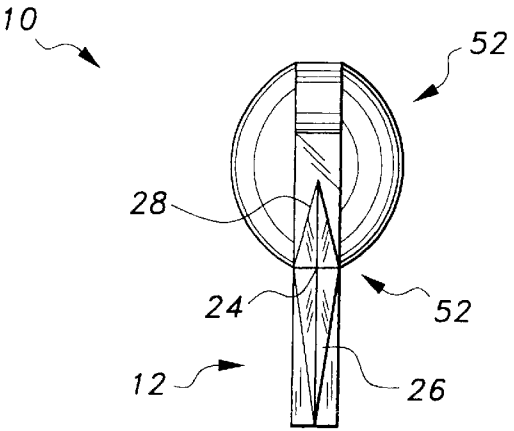
FIG. 3 is a front elevational view of the skinning knife according to the present invention.

The present invention is directed to a knife utilized preferably as a versatile one-step gutting and skinning knife for eviscerating large game. FIGS. 1, 2 and 3 illustrate by three different views the combination knife 10 having a steel blade 12 comprising a pointed tip portion 14, a main body portion 16 having a back edge 18 and a front edge 20, and a handle insert portion 22.

The following configuration of the knife 10 will be described for the front edge 20 beginning from the tip portion 14 comprising a sharp tip 24 and a first cutting bottom front edge 26 extending therefrom. A second cutting top back edge 28 extends from the sharp point 24. A serrated edge 42 adjacent the first cutting bottom front edge 26 comprises a series of larger cutting serrations 30 separated by two smaller cutting serrations 32 resulting in an improved sawing action.

On the back edge 18 of the knife 10, a first large gut hook 34 having a blunt tip 36 is provided adjacent the second cutting back top edge 28 (note FIGS. 2 and 3) for a dagger point. A triangular aperture 38 for tying hooks, inter alia, is provided adjacent the first large gut hook 34 having a straight inclined back top edge portion 40 bordering one side of and parallel to the triangular aperture 38 as an extension from the adjacent first large gut hook 34 for guiding the ripping action.

A second small gut hook 44 is provided as a significant feature of the present invention and having a sharp point 46 adjacent the rear of the second cutting bottom front edge 28 and opening toward the user. A circular aperture or forefinger hole 48 is provided adjacent the triangular aperture 38 and above the second gut hook 44. Each of the first and second gut hooks 34, 44, respectively, has a sharp beveled inner region 50.

A handle 52 has a three-finger configuration 54 of equal size indentations on a front edge 56. An optional looped cord 58 (shown in shadow) for hanging the knife 10 on a belt or a hanger can be inserted in an aperture 60 at the handle's end 62. The handle insert portion 22 is secured in the handle 52 by rivets 64.

A plastic or leather sheath can be provided to cover the main blade body 16.

Exemplary dimensions of the knife 10 are as follows:

Knife 10: overall length of 8 in.; steel blade 12, 4 1/16 in. length and 3/8 in. thick; first cutting front bottom edge 26 length 2 1/4 in.; serrated edge 42 length 1 9/16 in.; second cutting back top edge 28 length 1 13/16 in.; and inclined back top edge 40 length, 2 1/2 in.;

handle 52: plastic composition, 3 13/16 in. length; width ranging up to 1 in. configured with an ergonomic handle shape; and aperture 60 for cord 58, 1/4 in. diameter;

First large gut hook 34: 3/4 in. deep; 3/8 in. wide;

Second small gut hook 44: 3/4 in. deep; opening 1/2 in. narrowing to 1/4 in.;

Triangular aperture 38: 1 3/8 in. hypotenuse; 1" height or length; 30° arc base;

Forefinger hole 48: 15/16 in. diameter; and 3-finger handle configuration 54: 1 in. width for each curved notch.

It should be noted that the inventive knife can be utilized by people other than hunters, such as fisherman, trappers, butchers, and military personnel.

It is to be understood that the present invention is not limited to the sole embodiment described above, but encompasses any and all embodiments within the scope of the following claims.

We claim:

1. A combination knife for skinning and eviscerating game comprising:

a handle; and a steel blade having a tip portion, a main body portion having a back top edge and a front bottom edge, and a handle insert portion, the handle insert portion being attached to the handle, and the following configuration of the knife beginning from the tip portion: a sharp point, a first cutting front bottom edge extending from the sharp point, a second cutting back top edge extending from the sharp point; a first large gut hook adjacent the second cutting back top edge; a triangular aperture adjacent the first large gut hook; a sharp serrated edge adjacent the first cutting front bottom edge; a second small gut hook adjacent the serrated edge; and a circular aperture adjacent the triangular aperture and the second gut hook;

whereby the second smaller gut hook can be utilized without reversing one's grip on the handle.

2. The combination skinning and eviscerating knife according to claim 1, wherein the handle has a front bottom edge and an end opposite the blade, the handle having a three-finger configuration defined on the front bottom edge and further comprising a looped cord attached to the end of the handle.

3. The combination skinning and eviscerating knife according to claim 1, further including an inclined straight back top edge bordering one side of and parallel to the triangular aperture forming an extension from the adjacent first large gut hook.

4. The combination skinning and eviscerating knife according to claim 1, the first and second gut hooks each have sharp beveled inner regions.

5. A combination knife for skinning and eviscerating game comprising:

a steel blade having;
- a tip portion;
- a main body portion having:
  - a top back edge;
  - a bottom front edge;
  - a rear portion; and
- a handle insert portion;

said steel blade having the following configuration beginning at said tip portion:
- a sharp point,
- a first sharp cutting bottom front edge extending from said sharp point along said main body portion,
- a second cutting back top edge extending from said sharp point along said main body portion,
- a first large cutting gut hook adjacent said second cutting back top edge and opening toward said rear portion,
- a second small cutting gut hook to the rear of said first cutting front bottom edge opening to the rear; and a handle located on said handle insert portion;

said second small cutting gut hook being located substantially below said handle;

whereby said second smaller gut hook can be utilized without reversing one's grip on said handle.

6. The combination knife according to claim 5, said main body portion defining a generally circular forefinger aperture adjacent said first cutting bottom front edge, spaced above said second smaller gut hook, and in the vicinity of said handle.

7. The combination knife according to claim 6, said main body further comprising a sharp serrated edge extending between said first cutting bottom front edge and said second smaller gut hook.

8. The combination knife according to claim 6, wherein said second cutting back top edge is a beveled sharp edge.

9. The combination knife according to claim 6, wherein said second cutting back top edge is a beveled dull edge.

10. The combination knife according to claim 6, said main body defining a triangular aperture to the rear of said first large gut hook.

11. The combination knife according to claim 5, said handle having a three-finger configuration on a front bottom edge.

12. The combination knife of claim 10, said main body further comprising an inclined straight back top edge bordering one side of and parallel to said triangular aperture as an extension from the rear of said adjacent first large gut hook.

13. The combination knife of claim 7, wherein each of said first and said second gut hooks comprise sharp beveled inner regions.

14. The combination knife of claim 13, wherein said first gut hook ends in a dull point above said back top edge and said second gut hook ends in a sharp point to the rear of said serrated edge.

15. The combination knife of claim 7, wherein said serrated edge comprises a series of larger cutting serrations, each separated by two smaller cutting serrations.

16. The combination knife of claim 5, wherein said steel blade tip portion and said main body portion have a combined length of about 4 inches in length.

17. The combination knife of claim 16, wherein said first cutting bottom front edge is about 2 ¼ inches in length and said second cutting back top edge is about is about 1 13/16 inches in length.

18. The combination knife of claim 17, wherein said serrated edge is about 1 9/16 inches in length.

19. The combination knife of claim 5, wherein said first large gut hook is about ¾ inches deep, and having a width of about ⅜ inches, and wherein said second small gut hook is about ¾ inches deep, and having a maximum width of about ½ inch narrowing to about ¼ inch in width.

20. The combination knife of claim 6, wherein said forefinger aperture is about 15/16 inches in diameter.

* * * * *